United States Patent [19]

Kussy

[11] 4,072,916

[45] Feb. 7, 1978

[54] STACKED CIRCUIT BREAKERS HAVING HIGH INTERRUPTING CAPACITY

[75] Inventor: Frank W. Kussy, Randallstown, Md.

[73] Assignee: I-T-E Imperial Corporation, Spring House, Pa.

[21] Appl. No.: 642,497

[22] Filed: Dec. 19, 1975

[51] Int. Cl.[2] ..... H01H 75/00

[52] U.S. Cl. ..... 335/16; 335/195

[58] Field of Search ..... 335/8, 10, 16, 195, 335/18

[56] References Cited

U.S. PATENT DOCUMENTS

| | | | |
|---|---|---|---|
| 3,469,216 | 9/1969 | Shiraishi | 335/16 |
| 3,593,227 | 7/1971 | Mitskevich et al. | 335/16 |
| 3,646,488 | 2/1972 | Iida et al. | 335/16 |

*Primary Examiner*—George Harris

*Attorney, Agent, or Firm*—Ostrolenk, Faber, Gerb & Soffen

[57] ABSTRACT

A multipole molded case circuit breaker of moderately high rating is constructed of a stack of single pole units each having a contact operating mechanism and a trip unit. The movable contact arm is so positioned that it is subjected to magnetic blow-off effect, which even at relatively low fault levels, tend to open the contacts to enduce a current limiting action. A conducting strap within each pole unit housing is connected to the line terminal and is provided with a plurality of spaced connecting points each accessible through a different opening at the rear of the housing for connection to a panelboard bus bar.

12 Claims, 4 Drawing Figures

STACKED CIRCUIT BREAKERS HAVING HIGH INTERRUPTING CAPACITY

This invention relates to circuit breakers in general and more particularly relates to a construction for molded case circuit breakers of moderately high current rating.

Molded case circuit breakers of moderately high current rating, say 150 amps at 600 volts with an interrupting capacity of greater than 10,000 amps, are usually constructed as multipole units in which a single operating mechanism is provided for all poles. These circuit breakers are usually much larger than would be expected based solely on voltage and continuous current ratings because, under present standards in the U.S., this type of circuit breaker must interrupt high fault currents at full voltages in single and three pole arrangements, so that upon the occurrence of a short circuit the circuit breaker elements are subjected to great mechanical forces generated by magnetic effects which accompany high current flow.

In order to reduce the size of this type of circuit breaker and to simplify assembly thereof, the instant invention provides a construction in which a multipole breaker is constructed of single pole units stacked side by side, with each pole having its own operating mechanism. Fault current tripping of one pole transmits a tripping impulse to all other poles, so that for practical purposes all poles open simultaneously. In accordance with with the instant invention, current limiting action is obtained at relatively low fault current conditions by utilizing a blowoff effect achieved by closely spacing elements which carry currents in opposite directions. In particular, in the closed position of the circuit breaker, substantially the entire length of the movable contact arm is generally parallel to a strap on which the stationary contact is mounted and spacing between the strap and contact arm is less than the thickness of the contact arm.

Mounting the circuit breaker of the instant invention to a conventional type phase-sequence panelboard is relatively simple in that each pole is provided with a terminal strap extension having connecting points that are selectively accessible through a plurality of recesses at the rear edge of the pole unit. Stab-type connectors, either male or female, may be mounted to the terminal extension at a desired connecting point so as to be engageable with a selected panelboard bus bar, in that each connecting point positions a stab-type connector to engage a differently phase bus. In the alternative, the terminal extension may be connected to a panelboard bus bar through a spacer which extends forward from a bus bar.

Accordingly, a primary object of the instant invention is to provide a novel construction for a molded case circuit breaker.

Another object is to provide a circuit breaker of this type in which a relatively high capacity multipole unit is constructed by stacking a plurality of single pole units in side-by-side relationship.

Still another object is to provide a circuit breaker of this type which utilizes current limiting action of closely spaced elements carrying currents in opposite directions.

A further object is to provide a circuit breaker of this type that may readily be connected to the bus bars of a phase-sequenced panelboard.

A still further object is to provide a circuit breaker of this type in which current limiting action takes place at relatively low fault current levels.

These objects as well as other objects of this invention shall become rapidly apparent after reading the following description of the accompanying drawings in which.

Figure 1:
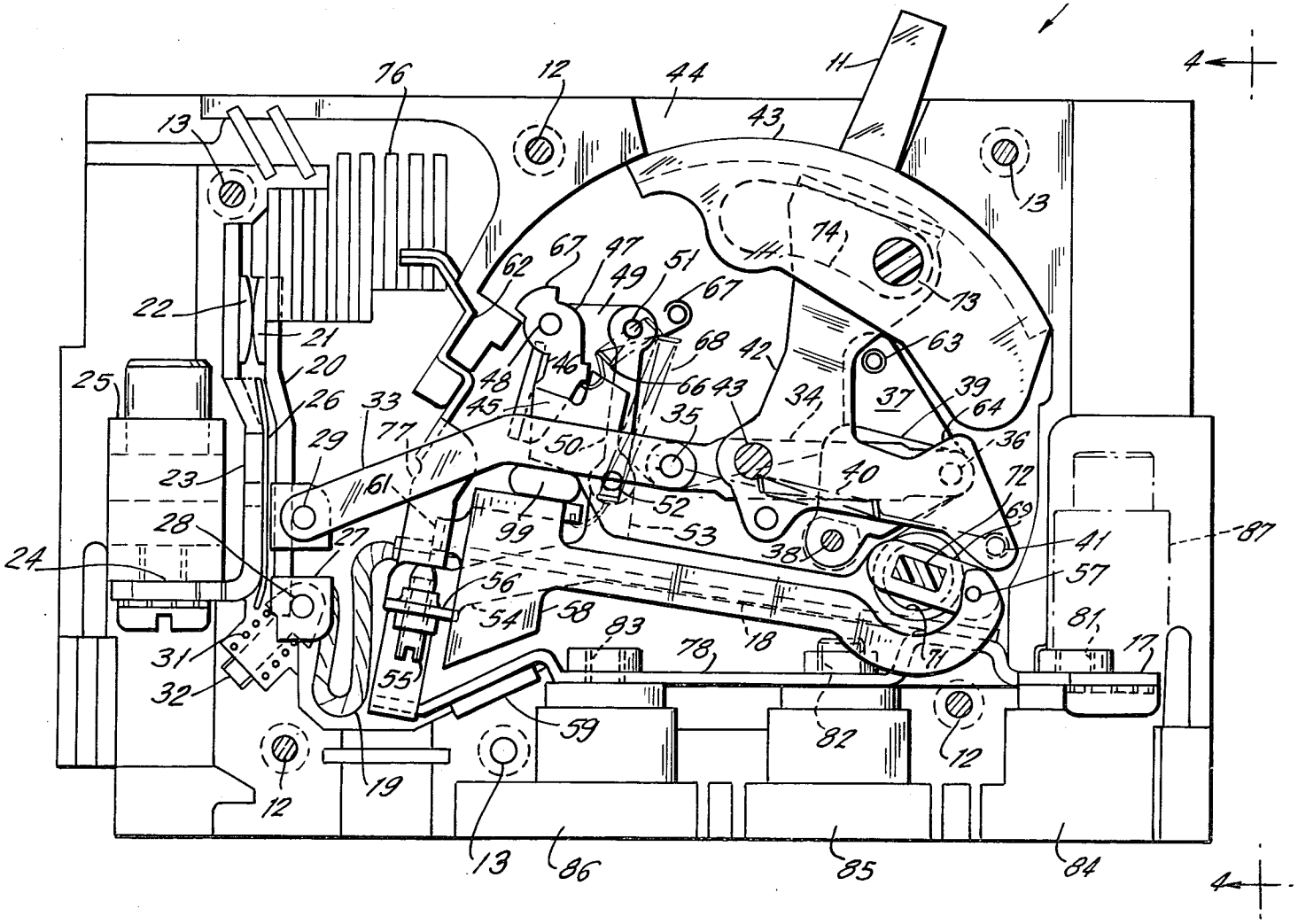
FIG. 1 is a side elevation of a pole unit constructed in accordance with teachings of the instant invention, with the near side of the housing removed. In this figure the circuit breaker is closed.

Now referring to the figures. Three pole circuit breaker 10 of FIG. 4 is constructed of three single pole units A, B, and C stacked in side-to-side relationship and held assembled by three rivets 12. These pole units or single pole circuit breakers A, B, C are substantially identical, the principal difference being that center pole unit B of FIGS. 1–3 includes manually operable extension 11 while the outer pole units A and C do not include such an extension.

Circuit breaker pole unit B includes a relatively narrow generally rectangular housing consisting of molded base 14 and molded cover 15 joined along line 16, as seen in FIG. 4, and secured together by three rivets 13. In a manner well known to the art of molded case circuit breakers, base 14 and cover 15 are provided with internal formationtions and cutouts to operatively position and/or guide the main elements of the circuit breaker.

The current path through pole unit B extends from line terminal 17, bimetal 18, flexible braid 19, movable contact arm 20, movable contact 21, stationary contact 22, and terminal strap 23 with its load terminal end 24 having wire grip 25 mounted thereon. For a reason which will hereinafter be explained, when pole unit B is closed (FIG. 1) the main central portion of terminal strap 23 and contact arm 20 are extremely close to one another for most of the length of contact arm 20, with thin insulating member 26 being interposed between contact arm 20 and terminal strap 23.

U-shaped metal bracket 27 is secured to the rear or lower end of contact arm 20 and is provided with a pair of spaced apertures through which pin 28 extends and another pair of spaced apertures through which pin 29 extends. Pin 28 pivotally supports contact arm 20 in housing 14, 15, with the ends of pin 28 being disposed within aligned slightly elongated guidance slots in base 14 and cover 15. Coiled compression spring 31 is wound about guide element 32 which is pivotally mounted at one end thereof to pin 28. Spring 31 bears against housing formations and pivot pin 28 so as to bias the latter generally forward. The provision of spring 31 facilitates maintaining acceptable tolerances between elements of circuit breaker B.

Pin 29 disposed forward of pivot pin 28 is connected to one end of bifurcated toggle arm 33. The other end of arm 33 is connected at toggle knee 35 to the bifurcated sections of the other toggle arm 34 whose other end is connected by pin 36 to cradle 37. The latter is mounted on a fixed pivot provided by pin 38 whose ends are captured in aligned recesses of base 14 and cover 15. Cradle 37 and spacers 39 are sandwiched between the sections of toggle arm 34. Operating forces and contact pressure forces for circuit breaker B are provided by the coiled tension sections of main spring 40 connected between toggle knee 35 and pin 41 secured to the arms of inverted U-shaped operating member 42. The latter is mounted within housing 14, 15 on fixed pivot 43 so as to be movable between the positions shown in FIGS. 1 and 2.

Mounted on member 42 at its forward end is handle-cap-unit 43 whose forward extension 11 projects externally of housing 14, 15 through front opening 44. The end of cradle 37 remote from toggle pivot 36 constitutes latching tip 45 which is engageable by latch plate 46 on latch member 47. The latter is pivoted on pin 48 and is provided with extension 49 that is connected by pin 51 to the forward end of connecting element 50. The rear end of element 50 is connected by pin 52 to forward extension 53 of trip arm 54. The latter is provided with tab 56 through which adjusting screw 55 extends, so that its forward end is engageable by the free end of bimetal 18 as this free end deflects rearward upon heating of bimetal 18.

The end of arm 54 remote from tab 56 is mounted on pivot pin 57, which also pivotally mounts the support arms for U-shaped magnetic armature 58. Bimetal 18 extends between the arms of armature 58 which is attracted to stationary yoke 59 upon the occurrence of predetermined overload conditions. The attraction of armature 58 to yoke 59 opposes the forwardly directed force exerted by biasing spring 68 connected between armature 58 and fixed pin 67. Spring 66 connected between pin 67 and latch member 47 biases the latter counterclockwise about pivot 48 to latching position and in doing so also biases connecting member 50 forward.

As armature 58 moves rearward toward yoke 59, armature projection 61 engages trip arm 54 thereby pivoting the latter counterclockwise with respect to FIG. 1 about pivot 57. This moves connecting link 50 rearward thereby pivoting latch member 47 clockwise and releasing latch 46 to free cradle 37. Now the forces provided by main spring 40 are transmitted through toggle arm 34 forcing cradle 37 to pivot clockwise. When toggle pivot 36 moves to the rear of the line of action of main spring 40, toggle knee 35 moves rapidly in a clockwise direction about pivot 36 thereby drawing toggle pivot 29 to the right with respect to FIG. 1. This causes clockwise pivoting of movable contact arm 20 thereby separating cooperating contacts 21, 22. Opening movement of contact arm 20 is limited by its engagement with arcing horn 62.

Figure 3:
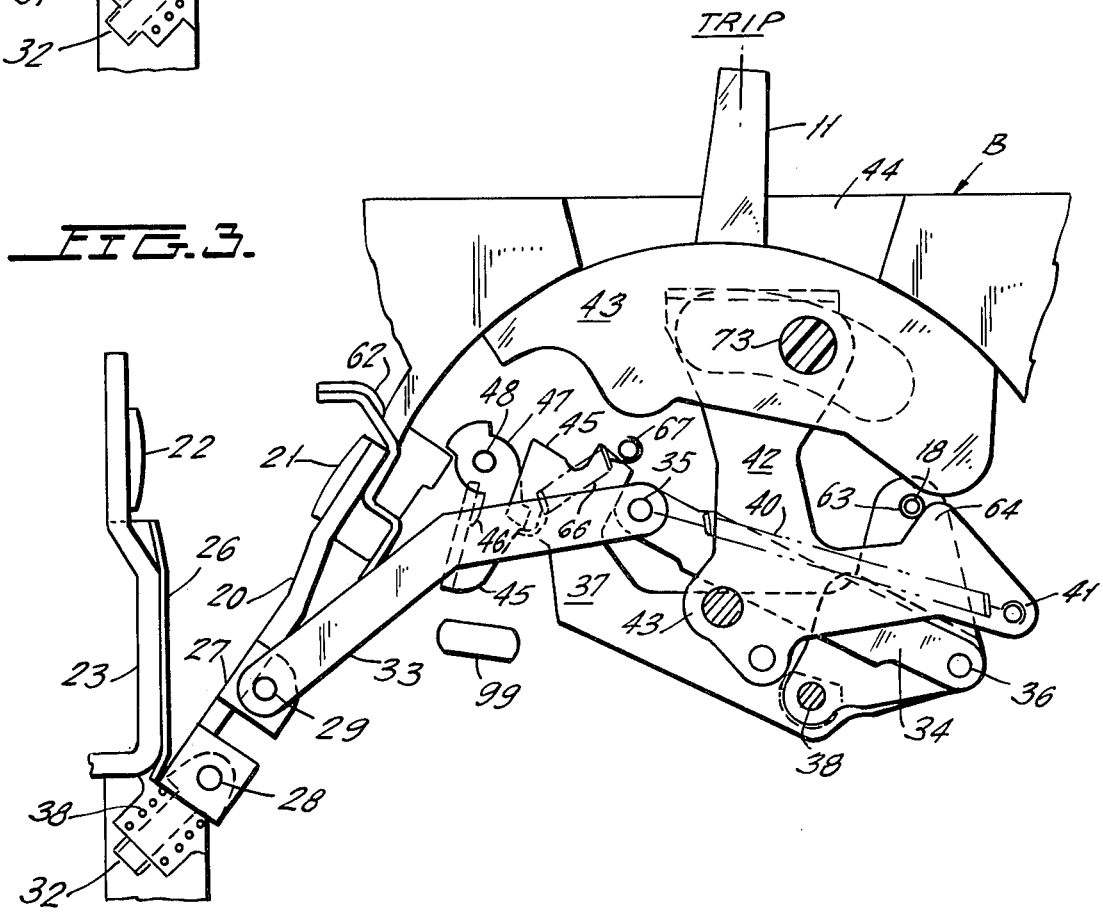
Figure 4:
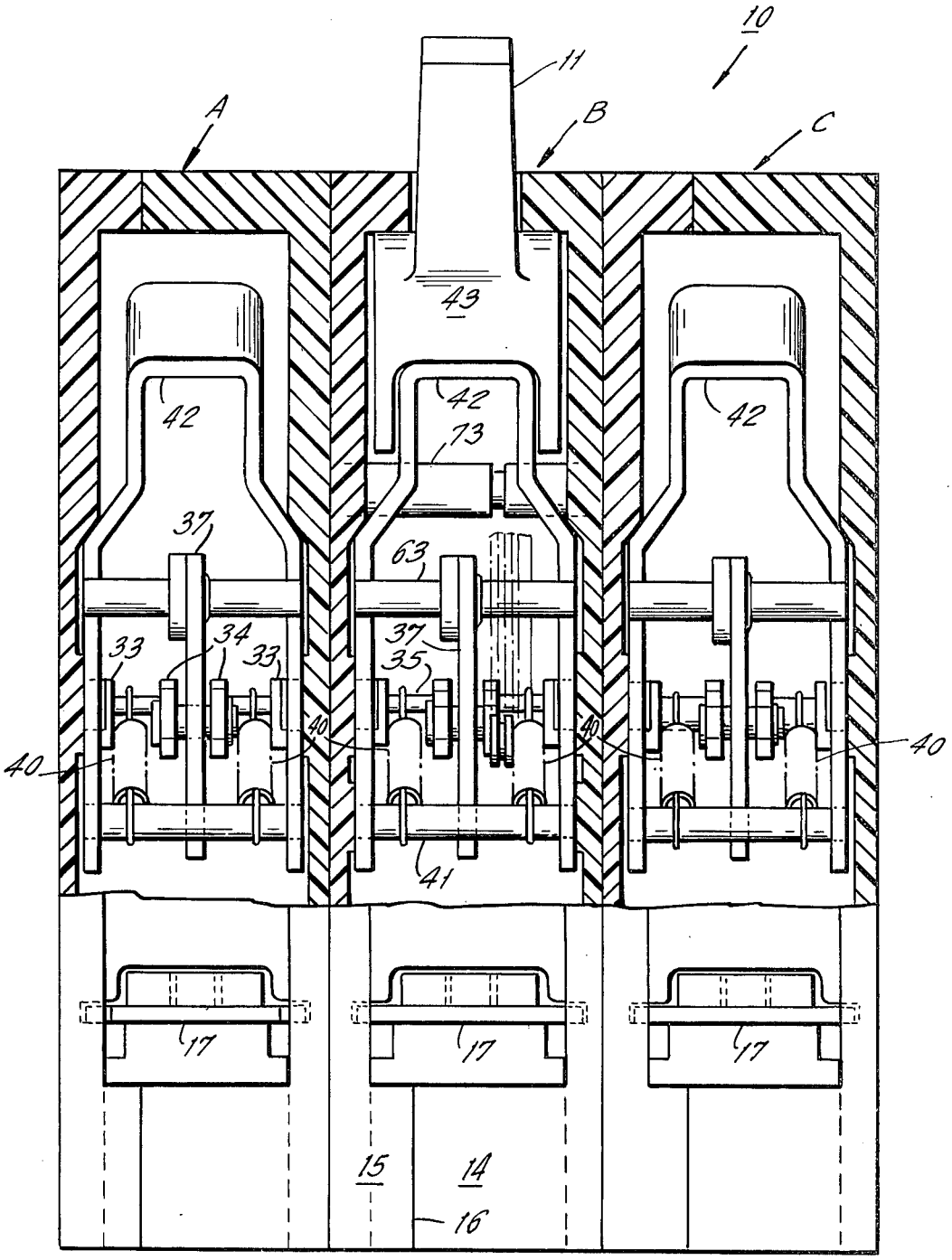
FIG. 4 is a line end view of a multipole unit constructed in accordance with teachings of the instant invention, looking in the direction of arrows 4—4 of FIG. 1, with portions broken away to reveal internal elements.

The elements finally come to rest in the intermediate trip position of FIG. 3, with reset pin 63 on cradle 37 abutting operating member formation 64 to indicate that circuit breaker 10 has tripped open because of a fault current condition.

Figure 2:
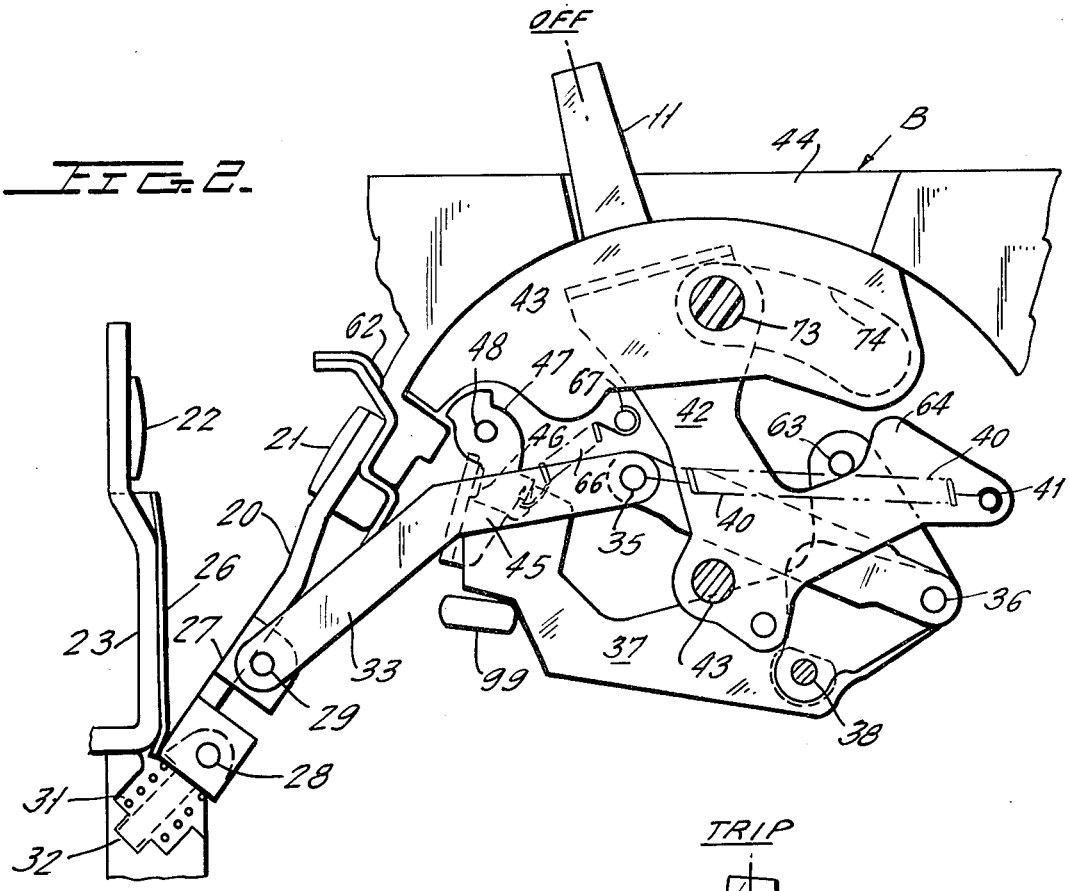
FIGS. 2 and 3 are fragmentary portions of FIG. 1, with the circuit breaker elements shown manually open in FIG. 2 and tripped open in FIG. 3.

Movement of manual handle 11 from the On position of FIG. 1 to the Off position of FIG. 2 moves pin 41 on member 42 forward thereby changing the line of action for spring 40. When pin 41 is positioned so that the line of action of spring 40 moves above toggle end 36 the toggle collapses with knee 35 moving forward or upward, thereby opening cooperating contacts 21, 22. Opposite motions of these elements occur when handle 11 is moved from the Off position of FIG. 2 to the On position of FIG. 1. As the toggle extends, its arm 33 engages base formation or stop 99 which prevents knee 35 from going over center. Thus, even though spring 40 may be over center in the closing direction, toggle 33, 34 is not locked against opening when a force directed to the right with respect to FIG. 1 acts on connecting pin 29. Thus, upon the occurrence of a fault currents flowing in opposite directions through terminal strap 25 and contact arm 20 generate a mechanical force on pin 29 tending to collapse toggle 33, 34. This permits contacts 21, 22 to part as a result of magnetic blow-off effects even before latch 47 is released.

Pole unit B is also provided with element 69 pivotally mounted on pin 57 and having a rectangular opening aligned with circular openings 71 in housing 14, 15. Elements 69 of all poles A-C are interconnected by transverse rod 72, so that all of the elements 69 move in unison. When any one of the pole units A through C trips automatically, its cradle 37 in pivoting clockwise engages element 69 causing it to pivot counterclockwise. This in turn moves tie bar 72 rearward into engagement with trip members 54 causing the latter to pivot counterclockwise drawing connecting member 50 rearward and releasing the latch tips 45 of the cradles 37 in the non-faulted poles thereby opening these poles when the faulted pole opens.

Round tie rod 73 extends between all poles A through C through generally arcuate housing apertures 74 and interconnects the operating members 42 of all pole units A through C so that manual operation of the central pole unit handle extension 11 manually operates all of the pole units A through C to their open and close positions.

When the contact arm reaches the fully open position during interruption of a high magnitude fault, the arc drawn in parallel plate arc chute 76 extends to arcing horn 62 so that current flows through the forward extension 77 of the latter and through conducting bar 78 to line terminal 17, thereby bypassing bimetal 18 to prevent the latter from carrying excessive currents.

Line terminal 17 is formed at one end of bar 78. The latter is provided with three threaded apertures 81, 82, 83 spaced along the length thereof. These apertures 81, 82, 83 constitute formations for securement by screws of elements such as spacers and tulip connectors for connecting pole unit B to a panelboard bus bar. For this purpose, apertures 81, 82, 83 are aligned with the respective recesses 84, 85, 86 at the rear of housing 14, 15. These recesses 84-86 are intended to house portions of tulip connectors and the like, and are deep enough so that there is sufficient spacing between bar 78 and panelboard bus bars passing behind bar 78 and not electrically connected thereto. It should now be apparent that only one connector location 81 through 83 is utilized for each pole unit A through C depending upon the location of the panelboard bus bar to which the particular bar 78 is to be electrically connected.

In the event pole unit B is not connected to a panelboard but is mounted within an enclosure, electrical connection may be made to line terminal 17 by mounting a wire grip 87 on the forward surface of line terminal 17.

Although there have been described preferred embodiments of this novel invention, many variations and modifications will now become apparent to those skilled in the art. Therefore, this invention is to be limited not by the specific disclosure herein but only by the appending claims.

The embodiments of the invention in which an exclusive privilege or property is claimed are defined as follows:

1. A circuit breaker including stationary contact means; movable contact means operable into and out of engagement with said stationary contact means to respectively close and open said circuit breaker; an operating mechanism for moving said movable contact means to open and close said circuit breaker; automatic trip means to actuate said mechanism to open said circuit breaker when said circuit breaker is subjected to fault current conditions; first and second spaced terminals; circuit means, including said movable and fixed contact means, extending between said terminals; said circuit means also including first and second elongated sections with said first section constituting at least part of an arm mounting said movable contact means and connected to said mechanism to be movable thereby for opening and closing said circuit breaker; with said circuit breaker closed, said sections being in confronting closely spaced relationship with currents flowing therethrough in opposite directions to create a magnetic blow-off force tending to open said circuit breaker prior to actuation of said mechanism to open said circuit breaker; said operating mechanism including a toggle connected to said arm and including first and second links connected at a movable knee which, for all positions of said arm, remains on the same side of a straight line extending between pivots at opposite ends of said toggle; said mechanism also including main spring means connected to said toggle at said knee to provide power for opening and closing said circuit breaker; said first section being pivoted to a pivot at one end thereof and mounting the movable contact means at the other end thereof; said second section at one end thereof mounting said stationary contact means and said first terminal being at the other end thereof; said first terminal being disposed in the general vicinity of said one end of said first section.

2. A circuit breaker as set forth in claim 1 also including a generally flat housing having first and second ends connected by a front and a back; said mechanism including an operating handle extending externally of said housing through an opening in said front; said first terminal being at said first end.

3. A circuit breaker as set forth in claim 2 in which the sections are within said housing with said second section extending generally parallel to said first end.

4. A circuit breaker as set forth in claim 3 in which the automatic trip means includes an elongated bimetal; said mechanism including a cradle and latch for normally latching said cradle in a reset position; said bimetal upon predetermined deflection thereof operatively engaging said latch for operation thereof to release said cradle and permit same to be operated to tripped position wherein operation of said handle is ineffectual to close said circuit breaker; said bimetal having one end fixed and the other end deflectable to engage a transfer arm which transmits motion of said bimetal to said latch for tripping thereof.

5. A circuit breaker as set forth in claim 4 in which the bimetal comprises a portion of said circuit; an electromagnet including a movable armature engageable with said transfer arm; said bimetal providing an energizing turn for said electromagnet.

6. A circuit breaker as set forth in claim 4 in which the latch is positioned forward of said bimetal; said toggle having one end connected to said arm and the other end connected to said cradle; said spring means being connected at one end to said knee and at the other end to an extension of said handle.

7. A circuit breaker as set forth in claim 4 also including an elongated conducting bar disposed within said housing and connected to one of said terminals; said bar having at each of a plurality of locations spaced therealong, means defining a connecting point adapted to have connected thereat means of electrically connecting said bar to a panelboard bus bar.

8. A circuit breaker as set forth in claim 7 in which there are a plurality of recesses at the back of said housing aligned with said connecting points and through which said connecting points are accessible from outside of said housing.

9. A circuit breaker as set forth in claim 1 also including a thin insulating member interposed between said sections when said circuit breaker is closed.

10. A circuit breaker as set forth in claim 9 in which the thickness of the insulating member is less than the thickness of said arm whereby with said circuit breaker closed spacing between said sections is less than the thickness of said arm.

11. A circuit breaker as set forth in claim 1 in which with said movable and stationary contact means engaged said main spring means being the sole biasing means providing contact pressure.

12. A circuit breaker as set forth in claim 1 in which the arm is a single member and the pivot therefor is in a generally fixed position; said toggle being pivotally connected to said arm at a point thereof intermediate the pivot and the movable contact means.

* * * * *